US011746403B2

(12) United States Patent
Grewe et al.

(10) Patent No.: US 11,746,403 B2
(45) Date of Patent: Sep. 5, 2023

(54) METHOD FOR PRODUCING A MOTOR VEHICLE COMPONENT FROM A 6000 SERIES ALUMINUM ALLOY

(71) Applicant: BENTELER AUTOMOBILTECHNIK GMBH, Paderborn (DE)

(72) Inventors: Jochem Grewe, Salzkotten (DE); Feng Jiao, Paderborn (DE); Friedrich Bohner, Oerlinghausen (DE); Jörn Tölle, Paderborn (DE); Nikolay Soritov, Paderborn (DE)

(73) Assignee: BENTELER AUTOMOBILTECHNIK GmbH, Paderborn (DE)

( * ) Notice: Subject to any disclaimer, the term of this patent is extended or adjusted under 35 U.S.C. 154(b) by 811 days.

(21) Appl. No.: 16/054,311

(22) Filed: Aug. 3, 2018

(65) Prior Publication Data

US 2019/0040507 A1 Feb. 7, 2019

(30) Foreign Application Priority Data

Aug. 3, 2017 (DE) ..... 10 2017 117 675.6

(51) Int. Cl.
*C22F 1/05* (2006.01)
*C21D 9/00* (2006.01)
(Continued)

(52) U.S. Cl.
CPC ..... *C22F 1/05* (2013.01); *C21D 9/0062* (2013.01); *C21D 9/0068* (2013.01); *C22C 21/04* (2013.01); *C22F 1/002* (2013.01)

(58) Field of Classification Search
None
See application file for complete search history.

(56) References Cited

U.S. PATENT DOCUMENTS

2012/0273098 A1* 11/2012 Bohner ..... C22F 1/047 148/695

FOREIGN PATENT DOCUMENTS

CN 106170577 11/2016
CN 106170577 A * 11/2016 ..... C22F 1/04
(Continued)

OTHER PUBLICATIONS

Davis, J.R. Metals Handbook Desk Edition, Second edition, DOI: 10.31399/asm.hb.mhde2.a0003177, p. 782-789. (Year: 1998).*
(Continued)

*Primary Examiner* — George Wyszomierski
*Assistant Examiner* — Janell C Morillo
(74) *Attorney, Agent, or Firm* — Nixon & Vanderhye P.C.

(57) ABSTRACT

A method for producing a motor vehicle component from a 6000 series aluminum alloy including providing a blank made of a 6000 series aluminum alloy, rapid heating of the blank to a temperature between 450 deg. C. and 600 deg. C. at a heating rate of more than 15 K/s in a period of less than 20 seconds, ending the heating process and optionally homogenizing, if a grain size between 20 and 50 μm has been produced, quenching the blank thus tempered, applying a lubricant, preferably at 20 deg. C. to 100 deg. C., forming the cooled blank in a forming tool, wherein the time between completion of the heating process and the start of the forming is less than 30 seconds, and aging.

12 Claims, 6 Drawing Sheets

(51) Int. Cl.
*C22F 1/00* (2006.01)
*C22C 21/04* (2006.01)

(56) References Cited

FOREIGN PATENT DOCUMENTS

| | | |
|---|---|---|
| CN | 106350716 | 1/2017 |
| DE | 10 2008 004 163 | 7/2008 |
| DE | 10 2012 007 213 | 11/2012 |
| DE | 10 2011 080 528 | 2/2013 |
| DE | 10 2013 103 469 | 10/2014 |
| EP | 2 518 173 | 10/2012 |
| WO | 2015/136299 | 9/2015 |

OTHER PUBLICATIONS

Davis, J.R. "Metals Handbook Desk Edition", 2nd Edition, pp. 426-436. (Year: 1998).*

Davis, J.R. "ASM Specialty Handbook: Aluminum and Aluminum Alloys", ASM International, pp. 685-686. (Year: 1993).*

Office Action issued in DE 10 2017 117 675.6, dated May 8, 2018, 7 pages.

Kammer "Aluminum Handbook: Fundamentals and Materials"(German Language), 2002, pp. 279-284.

Atenphol "Aluminum Viewed From Within: An Introduction Into The Metallurgy Of Aluminum Fabrication" (German Language), 1970, pp. 116-123 and 148-151.

English Translation of German Office Action issued in DE 10 2017 117 675.6, dated May 8, 2018, 6 pages.

Notification of Second Chinese Office Action and its English Translation for Chinese Application No. 201810874012.5, 18 pages, dated Feb. 10, 2021.

Notification of First Office Action for Chinese Application No. 201810874012.5, 22 pages, dated Apr. 1, 2020.

Chinese Rejection Decision and its English Translation for Chinese Application No. 201810874012.5, 13 pages, dated Sep. 28, 2021.

* cited by examiner

METHOD FOR PRODUCING A MOTOR VEHICLE COMPONENT FROM A 6000 SERIES ALUMINUM ALLOY

CROSS REFERENCE TO RELATED APPLICATION

The present application claims priority to German Patent Application Number 10 2017 117 675.6 filed, Aug. 3, 2017, the disclosure of which is hereby incorporated by reference in its entirety.

BACKGROUND

1. Field of the Invention

The disclosure is related to a method for producing a motor vehicle component and, more specifically, a method for producing a motor vehicle component from a 6000 series aluminum alloy in accordance with the features disclosed in patent claim 1.

2. Description of the Related Art

Producing motor vehicle components from metal material is known from prior art. In particular, structural components of a monocoque motor vehicle body, but also other add-on parts, such as, for example, bumpers, crash boxes or the like, and body components, for example, a door panel, roof skin, engine hood or mud guard, are made from metal material. In this case forming methods, such as deep drawing, are used.

Such motor vehicle components usually have a wall thickness ranging from 0.5 to 5 mm, in particular, from 1 to 3 mm.

In particular, safety-relevant components, for example, longitudinal members, motor vehicle pillars, in particular, B-pillars, sills or even cross members, need to have high strengths, in order to provide sufficient rigidity in the event of an accident and/or to stiffen the vehicle body.

Therefore, it is known from the prior art to use hot forming and press hardening technology for steels. As an alternative, the body components are produced from a light metal alloy, in particular, aluminum alloys. For this purpose it is known in turn, for example, from the document EP 2 518 173 A1, to heat treat a motor vehicle component made of an aluminum alloy before, during and/or after the production process, in order to control in a targeted manner the strength properties.

SUMMARY

According to an exemplary embodiment, the invention is embodied as a method for producing a motor vehicle component from an aluminum alloy that can be produced inexpensively, but at the same time highly effectively in the strengths to be achieved.

More specifically, the invention is embodied as a method for producing a motor vehicle component from a 6000 series aluminum alloy A method for producing a motor vehicle component from a 6000 series aluminum alloy is disclosed. The method includes providing a blank made of a 6000 series aluminum alloy, rapid heating of the blank to a temperature between 450 deg. C. and 600 deg. C. at a heating rate of more than 15 K/s in a period of less than 20 seconds, ending the heating process and homogenizing, if a grain size between 20 and 50 μm has been produced, quenching the blank thus tempered, applying a lubricant at a temperature between 20 deg. C. to 100 deg. C., forming the cooled blank in a forming tool, wherein the time between completion of the heating process and the start of the forming is less than 30 seconds, and aging.

Thus, the first step is to provide a blank made from a 6000 series aluminum alloy. The blank is preferably in the state F or T4 or T6 according to EN515. The state F refers to the hard rolled state without heat treatment. This blank may be already cut, for example, close to the final contour. However, this would be only one option.

At this point rapid heating, also called heating or heating up, is carried out in accordance with the present invention. In particular, contact heating by means of contact plates is used for this rapid heating. In this case, upon abutting contact, the heat of the contact plate is passed to the blank by thermal conduction. The blank is heated, according to the invention, to a temperature between 450 deg. C. and 600 deg. C. at a heating rate of more than 15 K/s in a period of less than 20 seconds, but at least in a few seconds. The rapid heating can take place in a heating station. However, the rapid heating can also take place in several heating stations or, more specifically, in several steps. For example, the rapid heating can be carried out in two steps or in three steps. The respective abutting contact in a heating step is less than 5 seconds. The transfer time between the steps is also less than 5 seconds, in particular, 2 seconds to 3 seconds. The transfer can be carried out with an axial conveyor, for example, with a transfer bar.

As soon as the target temperature has been reached by means of the heating process, the blank should have homogeneously this temperature across its surface and across its wall thickness. Homogenizing, which takes, however, a few seconds at least, could be optionally carried out. At the end of this heating process the material structure of the heated blank has a grain size between 20 and 50 μm. The grain size is measured, equiaxially, i.e., in all directions. The grain size was produced during the heating process and does not change any more in the following process. Then the heated plate is, in particular, quenched. The quenching is a rapid cooling, which can also be carried out preferably in several steps, in particular, in one to 3 steps. Thereafter or between two cooling steps at 20 deg. C. to 100 deg. C. a lubricant may be applied optionally to the blank. The lubricant application is carried out, in particular, by means of spraying, doctoring, rolling on; and, as an alternative, the lubrication may take place in the forming step itself. The forming dies of the forming tool are supplied with a lubricant. The advantage of cold forming is that any lubricant can be used; and it does not have to be able to withstand thermal stress.

In the next step the cooled or, more specifically, quenched blank is placed in a forming tool, where it is formed. Thus, the forming takes place as a cold forming process. In this case it is provided that the time between completion of the heating process or the homogenizing process and the start of the forming is less than 30 seconds. This means that the quenching and the transfer into the forming tool are carried out in a period of less than 30 seconds.

The quenching to a temperature of less than 200 deg. C. is carried out at a cooling rate of greater than 10 K/s. Then the blank could be cooled to a temperature of less than 100 deg. C. at a slower cooling rate. However, this cooling is also carried out, in particular, at a cooling rate of greater than 10 K/s.

The forming itself can also be carried out in several steps, in particular, in one to three steps. Optionally further trimming and/or perforation operations can be carried out during the forming process or also after the forming process.

The method of the present invention can be carried out, in particular, in a press system with a jointly driven ram. This means that the heating steps, the quenching steps and the forming steps are carried out in a press system. Thus, in the press cycle that is carried out preferably in less than 10 seconds, in particular, less than 5 seconds and even more preferably less than or equal to 3 seconds, but in at least 1 second, an inserted blank can be heated beginning in the first step. In the next cycle this blank, heated in the first step, is transferred to a second step, for example, also a heating step, where it is further heated. The second heating step is also used, for example, for homogenizing the temperature inside the blank, for example, in the form of a short holding phase. Then in the next cycle this second heating step is followed, for example, by a first cooling step, which in turn is followed by a second cooling step. The cooling steps are then followed in the next cycle by a first forming step, which in turn is followed by a second and optionally a third forming step. Before the first forming step or within it the blank may be trimmed. In particular, an edge trimming takes place. Hence, the opening and closing movement of the press system is carried out together. However, this does not have to mean that all of the steps have to be opened or closed simultaneously. A time lag between, in particular, forming steps and tempering steps, is permissible within the scope of the invention, in order to incorporate, for example, different closing times/holding time, to maximize, in particular, the contact time during tempering. Between the individual steps a transfer system is provided. Thus, an initially inserted blank passes through all of the steps and is formed into a motor vehicle component.

Individual steps, in particular, for heating and/or quenching, are carried out by means of contact plates. This means that both the heating by abutting contact is carried by contact plates; and the quenching by abutting contact is carried out in this case by cooling plates. Here spring-loaded contact plates can be used, so that the contact plates project in the direction of the press stroke, when the tool is opened. Therefore, during the closing movement the abutting time of the contact plates during the cycle is extended. As a result, the energy that is introduced for heating and cooling can be used more effectively.

At the same time the method is particularly energy efficient in short cycle periods and, as a result, can be carried out, in total, very cost effectively, even in the production of complex components.

For this purpose, in particular, an aluminum alloy is used that comprises the following alloy elements, expressed in percent by weight:

| | |
|---|---|
| silicon (Si) | 0.70 to 1.10, preferably 0.75 to 1.05 |
| magnesium (Mg) | 0.50 to 0.80 |

balance aluminum and impurities due to smelting

Furthermore, a thin alloy concept is used with preferably stoichiometric constitution.

For this purpose preferably a relative ratio of the fractions in percent by weight of magnesium to silicon ranging from 5 to 7 up to 5 to 9 is selected. This corresponds, in particular, to a stoichiometric constitution of the hardening phase Mg5Si6.

Furthermore, for the positive hardening behavior the total content of silicon and magnesium, expressed in percent by weight, together is selected greater than or equal to 1.20, preferably, however, less than or equal to 1.90.

Preferably,

| | |
|---|---|
| copper (CU) | 0.03 to 0.20 |
| manganese (Mn) | 0.10 to 0.20 |
| chromium (Cr) | 0.10 to 0.20 |
| titanium (Ti) | 0.010 to 0.030 |
| iron (Fe) | 0.10 to 0.25 |

are provided individually or together in the aforementioned aluminum alloy as other alloy elements, expressed in percent by weight.

The copper ensures the thermal stability, the rigidity, furthermore, the recrystallization process and the aging behavior.

The manganese content ensures a higher strength and the change in the grain size. Furthermore, manganese and chromium are used as retarders of the recrystallization. Chromium further increases the crash behavior. Titanium ensures a grain refinement during solidification.

Thus, the aforementioned aluminum alloy has optimized properties for an accelerated solution annealing treatment and at the same time optimal cold forming properties. Thus, in conjunction with a rapid heating rate an extremely fine grain size or grain structure can be produced during the heating process.

At the same time the material exhibits an improved flow behavior, so that critical excessive thinning during forming, in particular, during deep drawing operations, is avoided. In addition, the material has improved aging properties. As a result, a more rapid age hardening takes place. For this purpose it may be provided, in particular, that after completion of the forming process a cold aging (several days) or a hot aging (several hours to days) takes place.

Alternatively, upon completion of the forming process prior to aging, an intermediate annealing treatment is carried out at preferably 100 deg. C. to 200 deg. C. from 10 to 120 minutes. Thus, the motor vehicle component, which is produced from a 6000 series aluminum alloy with the method of the present invention, has optimized mechanical properties, in particular, if the aforementioned aluminum alloy is used. As a result, a yield limit Rp 0.2 of greater than 260 MPa, in particular, greater than 280 MPa can be produced. However, the yield limit of the component is, according to current understanding, less than 400 MPa. Furthermore, a tensile strength Rm of greater than 320 MPa, in particular, greater than 340 MPa can be produced in the motor vehicle component that is produced. However, according to current understanding, the tensile strength is less than 400 MPa.

An optimum of strength and ductility to be achieved can be obtained at a ratio of yield limit to tensile strength of less than or equal to 0.95.

Within the scope of the invention contact heating is carried out preferably for heating; and contact cooling is carried out for quenching. However, other heating methods, in particular, rapid heating methods, can also be used. For example, an electrical resistance heating can be carried out. Convection heating methods, radiation heating methods or also contact-free heating methods, for example, by induction, can also be carried out.

Furthermore, heating in the fluidized bed is suitable to achieve an optimal microstructure at the demanded heating rates. In this case the blanks are heated in an air swept heated container or, more specifically, a pan. The container or rather pan is heated, in particular, with aluminum oxide powder.

As an alternative, it is also conceivable that for a rapid heating rate an inductive heating of the blank is carried out, or also heating by means of infrared radiation. The blank can also be heated in a furnace, where in the furnace, in particular, a heated air stream is supplied at an angle, in particular, perpendicular to the blank to be heated. This heating method, in contrast to contact heating, is suitable, in particular, for heating three dimensionally formed profiles. In this case a flat blank is not heated, but rather a profile, which is designed, for example, in a hat shape in the cross section or as a multi-chamber profile. Thus, the heat can also enter into the profile cavities by thermal radiation and/or by convection and, in so doing, also heat, for example, the inner webs in a profile. In the case of heating in a furnace, a heating rate of greater than 4 to 15 K/s is preferred, in order to achieve a higher degree of fine granularity during solvent annealing. A dwell time in the furnace should not exceed in any event 3 minutes, including the holding time, at the target temperature. Heating with contact of a fluid medium would also be possible. Similarly both the blanks and the profiles can be heated by means of direct passage of current.

It is also possible that the blank or, more specifically, the profiles are coated prior to thermal treatment, i.e., prior to heating and/or prior to or during cooling. The coating is used, in particular, to control the input or removal of temperature in a targeted manner by thermal conduction. Hence, the heating rate or the cooling rate can be improved. The coating can also be applied locally, so that during thermal treatment different temperatures can be produced in certain regions of the blank.

However, it is particularly preferred that the contact heating be carried out at heating rates of greater than 15 K/s, in particular, greater than 25 K/s, more preferably greater than 50 K/s. Furthermore, it is particularly preferred that a contact cooling be carried out for quenching. In this case cooling rates of greater than 15 K/s, in particular, greater than 25 K/s and more preferably greater than 50 K/s are used. From an engineering perspective the cooling rate should be limited to greater than 500 K/s.

Furthermore, the present invention relates to the use of an aluminum alloy for producing a motor vehicle component, wherein the aluminum alloy comprises the following alloy constituents, expressed in percent by weight:

| | |
|---|---|
| silicon (Si) | 0.70 to 1.10, preferably 0.75 to 1.05 |
| magnesium (Mg) | 0.50 to 0.80 |
| copper (CU) | 0.03 to 0.20 |
| manganese (Mn) | 0.10 to 0.20 |
| chromium (Cr) | 0.10 to 0.20 |
| titanium (Ti) | 0.010 to 0.030 |
| iron (Fe) | 0.10 to 0.25 |

balance aluminum and impurities due to smelting

According to the disclosure, the blank is first heated at a heating rate of greater than 4 K/s. Then the heated blank is quenched at a cooling rate of greater than 10 K/s. Thereafter the blank, which has been thermally treated in such a manner, is cold formed. The forming takes place within 30 seconds after completion of the heating. In this way it is possible to produce a grain size between 20 and 50 μm in the material structure of, in particular, a motor vehicle component that has been produced from the aforementioned alloy.

BRIEF DESCRIPTION OF THE DRAWINGS

For an understanding of embodiments of the disclosure, reference is now made to the following description taken in conjunction with the accompanying drawings, in which.

In the figures, the same reference signs are used for identical or similar component parts, even if a repeated description is omitted for reasons of simplification.

DETAILED DESCRIPTION OF SOME EMBODIMENTS

Some embodiments will be now described with reference to the Figures.

Figure 1:
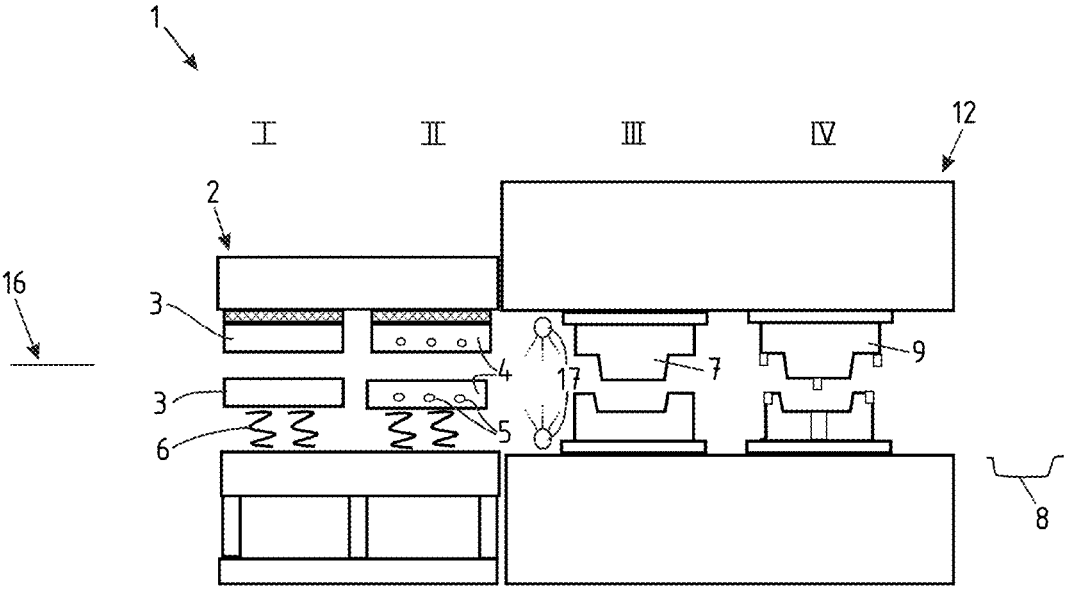
FIG. 1 illustrates an arrangement for carrying out the claimed method with a temperature control station and a forming and trimming station.

FIG. 1 shows an arrangement 1 for carrying the method of the current disclosure. The arrangement 1 includes a combined temperature control station 2. In a first step I a heating process takes place. For this purpose contact plates 3 are provided that are heated by means of a heat source (not shown in detail); and the inserted blank 16 is heated by abutting contact by means of thermal conduction. Thereafter a blank, which has been placed into the respective step, is also shown for reasons of simplification. A second step II provides cooling plates 4. The cooling plates 4 comprise cooling channels 5 for conveying a cooling fluid. Thus, the heated blank is cooled by abutting contact in the second step. Both the contact plates 3 and the cooling plates 4 are mounted by means of springs 6. As a result, the effective contact time can be increased during the tool closing time or while carrying out the cycle, since the plates protrude in the closing direction of the tool. The contact pressure is also homogenized; and the press deflection is compensated for. Optionally after the quenching operation a lubricant application system 17 is provided, which applies a lubricant to the blank by, for example, spraying.

The blank, which has been heated in the first step I and quenched in the second step II, is then transferred to a third step III, a forming station 12, where a forming tool 7 is provided for a first forming of the motor vehicle component 8 to be produced. A subsequent fourth step IV may comprise a forming step; in addition or as an alternative, it may also comprise a perforation and/or trimming tool 9. As an alternative or in addition, a further forming may also take place in this combined perforation or trimming tool 9. At the end of the process the formed motor vehicle component 8 is obtained, which in this case is a formed motor vehicle component 8, which has a hat shape in the cross section, only for illustrative purposes. The motor vehicle component may be a motor vehicle pillar, a longitudinal member or a cross member or any other body component or structural component; as an alternative, it may also be a chassis component, an exterior skin component or add-on part of a motor vehicle. A transfer system for conveying the blank is not shown.

Figure 2:
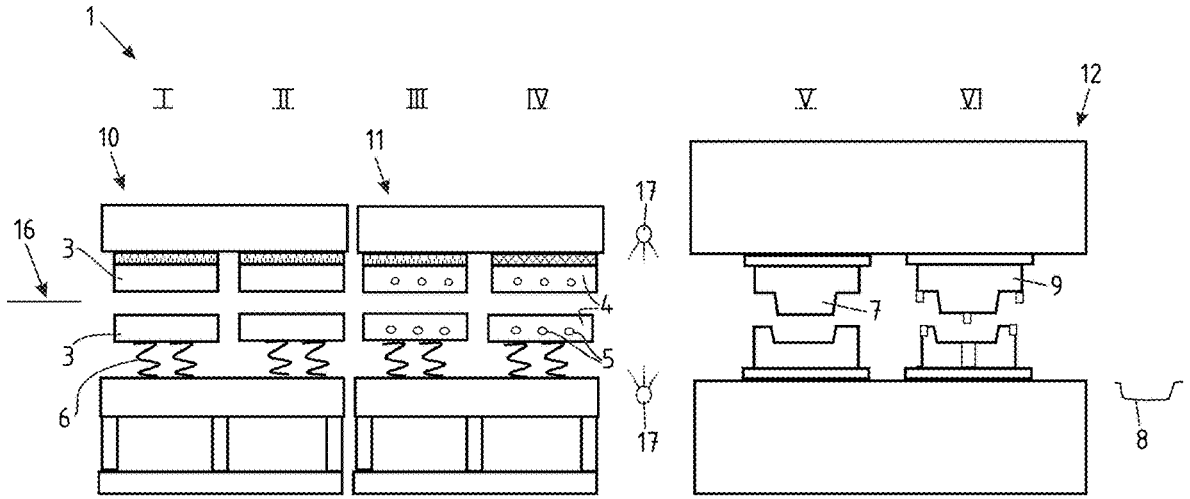
FIG. 2 illustrates an alternative arrangement to FIG. 1.

FIG. 2 shows an alternative to FIG. 1. The arrangement 1 is shown providing a heating station 10, a cooling station 11 and a forming station 12. In total, a six-step tempering and forming process is carried out, wherein in the first two steps I+II the blank is heated in the heating station 10. Then this heated blank 16 is transferred to a cooling station 11 and is quenched in the cooling station 11 in step III and step IV. Then in a fifth step V the blank 16, which has been heated and thereafter quenched, is transferred to a forming tool 7, where the blank is formed in at least one step and optionally is formed once again as well as trimmed and perforated in a sixth step VI. Between step IV and V the lubricant is applied, for example, by means of two-sided spraying. This application of the lubricant can take place with the lubricant application system 17. Obtained is a motor vehicle component 8, which is also configured in a hat shape in the cross section, shown here merely for illustrative purposes.

Figure 3:
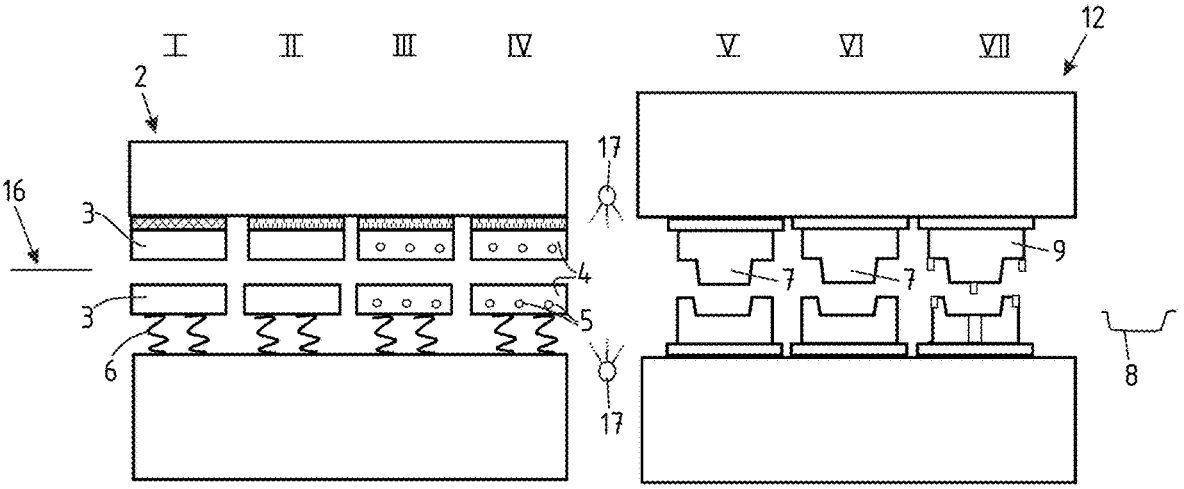
FIG. 3 illustrates an alternative arrangement to FIG. 1.

FIG. 3 shows an alternative arrangement, where once again there is a temperature control station 2, which both heats and cools. The process is shown in seven steps. The first four steps are carried out in the temperature control station 2. For this purpose the blank is heated in step I and step II. Then in steps III and IV a quenching operation takes place. Then the blank, which has been tempered in this manner, is transferred to a forming station 12, where it is formed as well as trimmed and perforated in the next three steps V-VII. Between step IV and V a lubricant is applied, for example, by means of two-sided spraying.

Figure 4:
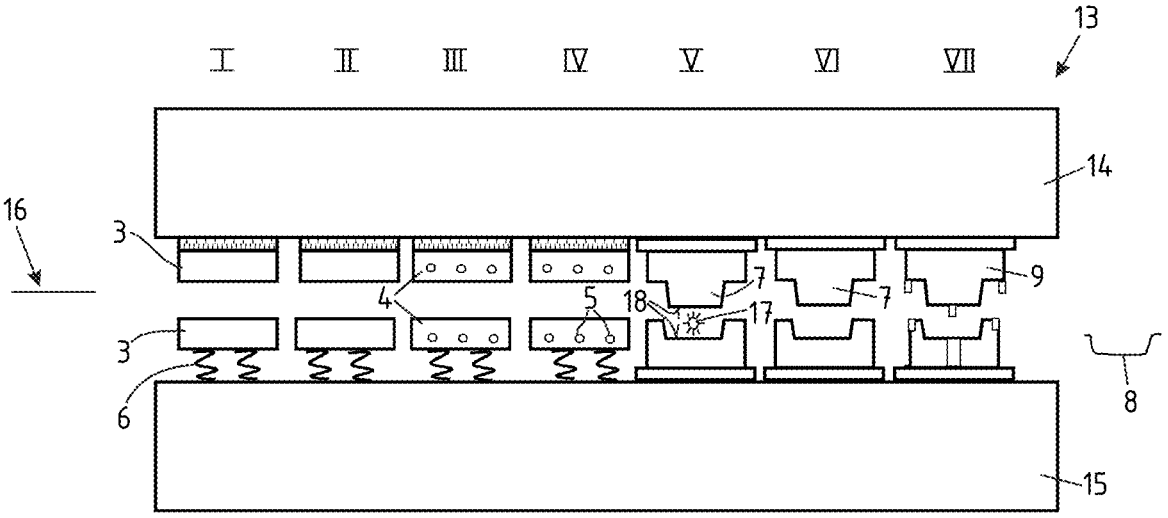
FIG. 4 illustrates an alternative arrangement to FIG. 1.

FIG. 4 shows an alternative design variant, where a joint temperature control and forming station 13 is shown. This means that all of the contact plates 3, the cooling plates 4, the forming tool 7 and the perforation and trimming tools 9 are suspended from or fixed to a press upper part 14 and a press lower part 15. A closing movement of the temperature control and forming station 13 requires that all of the steps I-VII be carried out simultaneously. Here, too, springs 6 are provided again, so that the effective contact time of contact plates 3 and cooling plates 4 during the movement of the, for example, upper tool 14 to the lower tool 15 is increased. Furthermore a lubricant application system 17 is shown here in the first forming step V. The lubricant application system applies lubricant to the forming dies 18 of the forming tools 7.

Figure 5:
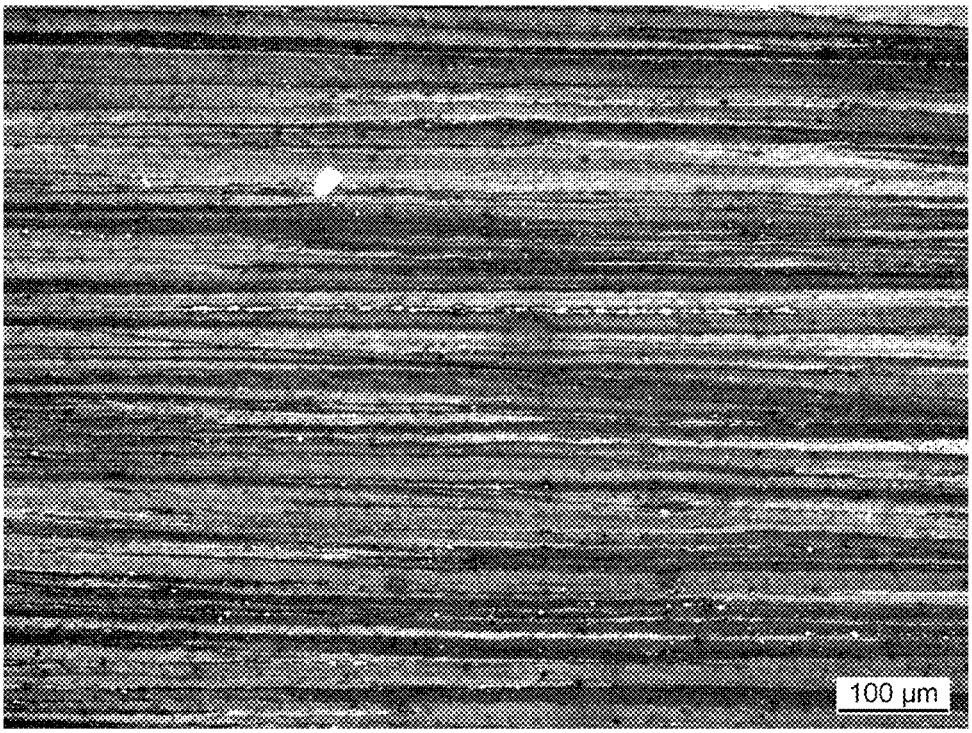
FIGS. 5 to 7 illustrate metallurgical grinding patterns.

FIG. 5 shows a metallurgical grinding pattern of a blank made of the aluminum alloy, described in accordance with the invention, in the provided state. A laminar structure can be seen here.

Figure 6:
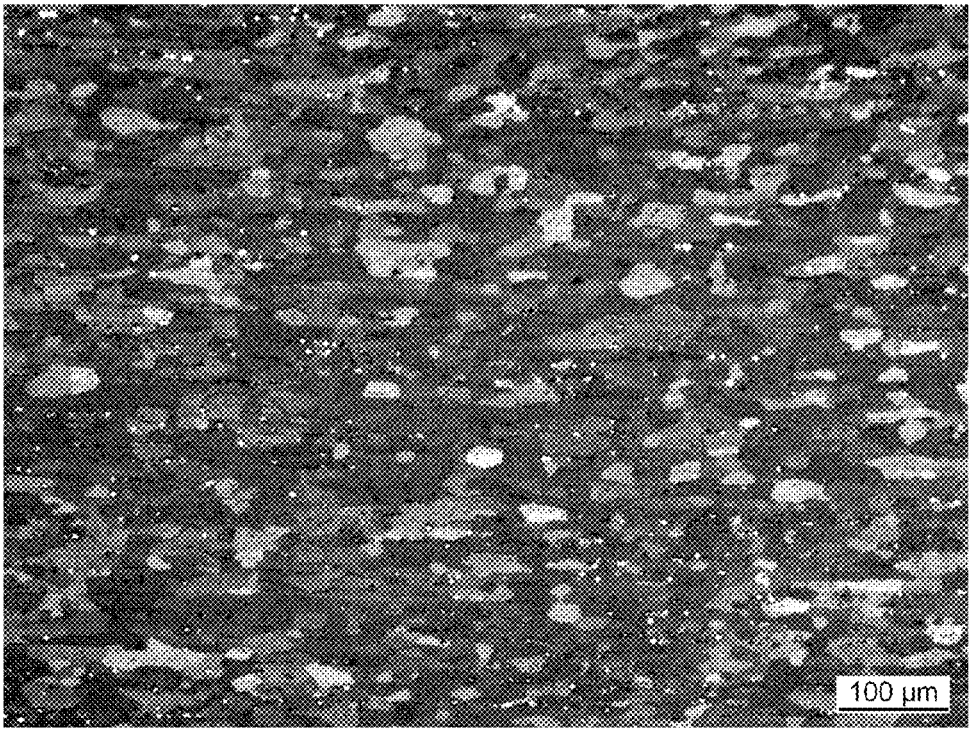

If at this point an inventive rapid heating is carried out with subsequent quenching, then the result is the material structure shown in FIG. 6, where it can be seen that individual grains, each exhibiting a grain size between 20 and 50 μm, have formed. The sizes specified herein refer to both an extent of the length and width in the image plane as well as an extent of the height into or out of the image plane. Thus, the grain size is configured to be equiaxial. After the subsequent forming, the grain size is configured to be more or less identical. Depending on the quenching occurring inside the wall thickness during the forming operation, the orientation of the grains is slightly distorted.

Figure 7:
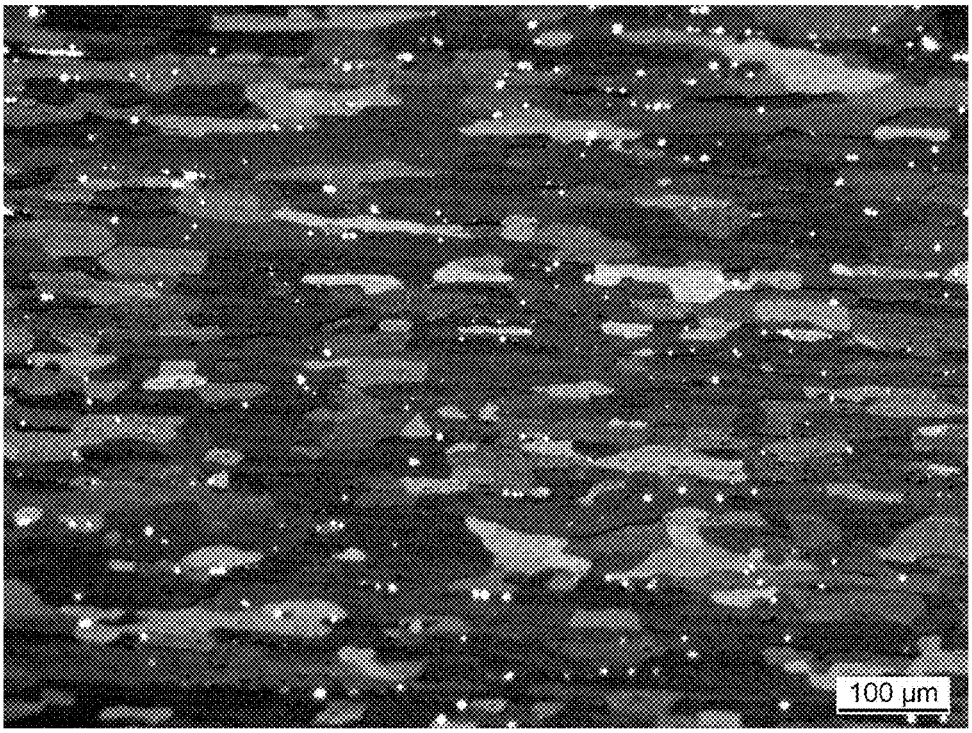

In contrast to FIG. 6, FIG. 7 shows a material structure, produced with slower and longer heating as well as slower and longer cooling, each lasting several minutes. It is apparent that a much larger grain size and also a grain structure other than that shown in FIG. 6 have been produced.

REFERENCE NUMERALS

1 arrangement
2 temperature control station
3 contact plates
4 cooling plates
5 cooling channels
6 springs
7 forming tool
8 motor vehicle component
9 perforation/trimming tool
10 heating station
11 cooling station
12 forming station
13 temperature control and forming station
14 press upper part
15 press lower part
16 blank
17 lubricant application system
18 forming dies

The invention claimed is:

1. A method for producing a motor vehicle component from a 6000 series aluminum alloy, comprising:

providing a blank made of a 6000 series aluminum alloy with a material structure, wherein the blank is in the state F temper condition according to EN515;

rapid contact heating of the blank to a temperature between 450 deg. C. and 600 deg. C. at a heating rate of more than 25 K/s in a period of less than 20 seconds;

solution annealing above 450 deg. C.;

ending the heating process after achieving a grain size between 20 and 50 μm for the material structure of the heated blank;

quenching the blank thus tempered;

applying a lubricant at a temperature between 20 deg. C. to 100 deg. C.;

cold forming the cooled blank in a forming tool, wherein the time between completion of the heating process and the start of the forming is less than 30 seconds;

wherein an aluminum alloy is used that comprises the following alloy elements, expressed in percent by weight:

| | |
|---|---|
| silicon (Si) | 0.70 to 1.10, |
| magnesium (Mg) | 0.50 to 0.80 |
| manganese (Mn) | 0.10 to 0.20 |

balance aluminum and impurities due to smelting, and wherein the aluminum alloy further comprises at least one of the following alloy elements, expressed in percent by weight:

| | |
|---|---|
| copper (CU) | 0.03 to 0.20 |
| chromium (Cr) | 0.10 to 0.20 |
| titanium (Ti) | 0.010 to 0.030 |
| iron (Fe) | 0.10 to 0.25; and |

aging.

2. The method according to claim 1, wherein a relative ratio of the fractions in percent by weight of magnesium to silicon is from 5 to 7 up to 5 to 9.

3. The method according to claim 1, wherein the content in percent by weight of magnesium and silicon together is greater than or equal to 1.20 and less than or equal to 1.90.

4. The method according to claim 3, further comprising producing a yield limit Rp 0.2 of greater than 260 MPa.

5. The method according to claim 4, further comprising producing a tensile strength Rm of greater than 320 MPa.

6. The method according to claim 4, further comprising producing a ratio of yield limit to tensile strength of less than or equal to 0.95.

7. The method according to claim 6, wherein the heating and/or quenching is carried out in a localized manner.

8. The method according to claim 7, further comprising heating and/or quenching the blank at varying contact pressure; or that the contact plates with different temperatures are used, so that during the thermal treatment different temperatures are produced in certain regions of the blank.

9. The method according to claim 8, wherein the heating is carried out by contact heating at a heating rate of greater than 20 K/s.

10. The method according to claim 9, wherein for rapid heating and/or quenching, contact plates are used, and wherein the contact plates comprise a coating.

11. The method according to claim 1, wherein the heating, cooling and/or forming is carried out in multiple steps.

12. A method for producing a motor vehicle component from a 6000 series aluminum alloy, comprising:

providing a blank made of a 6000 series aluminum alloy with a material structure, wherein the blank is in the state T4 or T6 prior to heating;

rapid contact heating of the blank to a temperature between 450 deg. C. and 600 deg. C. at a heating rate of more than 25 K/s in a period of less than 20 seconds;

solution annealing above 450 deg. C.;

ending the heating process after achieving a grain size between 20 and 50 μm for the material structure of the heated blank;

quenching the blank thus tempered;

applying a lubricant at a temperature between 20 deg. C. to 100 deg. C.;

cold forming the cooled blank in a forming tool, wherein the time between completion of the heating process and the start of the forming is less than 30 seconds;

wherein an aluminum alloy is used that comprises the following alloy elements, expressed in percent by weight:

| | |
|---|---|
| silicon (Si) | 0.70 to 1.10, |
| magnesium (Mg) | 0.50 to 0.80 |
| manganese (Mn) | 0.10 to 0.20 |

balance aluminum and impurities due to smelting, and wherein the aluminum alloy further comprises at least one of the following alloy elements, expressed in percent by weight:

| | |
|---|---|
| copper (CU) | 0.03 to 0.20 |
| chromium (Cr) | 0.10 to 0.20 |
| titanium (Ti) | 0.010 to 0.030 |
| iron (Fe) | 0.10 to 0.25; and |

aging.

* * * * *